US006780050B1

(12) United States Patent
Wu

(10) Patent No.: US 6,780,050 B1
(45) Date of Patent: Aug. 24, 2004

(54) RETAINING STRUCTURE OF LAMP FOR CONNECTING WIRES

(76) Inventor: Wen-Chang Wu, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/601,915

(22) Filed: Jun. 24, 2003

(51) Int. Cl.[7] ..... H01R 13/73

(52) U.S. Cl. ..... 439/544; 439/744; 362/405; 362/457

(58) Field of Search ..... 439/544, 535, 439/572, 569, 441, 595, 350, 744; 362/404–406, 457; 174/50, 54, 62; 248/343, 906

(56) References Cited

U.S. PATENT DOCUMENTS 6,502,966 B1 * 1/2003 Wu ..... 362/404
6,543,940 B2 * 4/2003 Chu ..... 439/535
6,589,075 B1 * 7/2003 Wu ..... 439/544
6,666,613 B2 * 12/2003 Wu ..... 362/405
6,682,303 B2 * 1/2004 Wu ..... 362/405
6,685,346 B2 * 2/2004 Wu ..... 362/405

* cited by examiner

*Primary Examiner*—Tho D. Ta

(57) ABSTRACT

A retaining structure of a lamp for connecting wires comprises a retaining box, a wire connecting box, a conductive receptacle, a cover and a lamp rod. A periphery of the retaining box has a plurality of through holes. A wire connecting box is made by plastic mold injection with a plurality of buckling seats. Each buckling seat is installed with an inserting hole, a pivotal seat and a via hole. The inserting hole is formed with at least one embedded hole. Each inserting hole is aligned and communicable to the through hole of the retaining box. A conductive receptacle is fixed to the inserting hole. The cover is formed with a plurality of limiting holes for covering the wire connecting box. A front end of the lamp rod is installed with a conductive plug and a rear end of each conductive plug is formed with a buckling groove.

6 Claims, 3 Drawing Sheets

RETAINING STRUCTURE OF LAMP FOR CONNECTING WIRES

FIELD OF THE INVENTION

The present invention relates to lamp retaining devices, and particularly to a retaining structure of a lamp for connecting wires.

BACKGROUND OF THE INVENTION

In the prior art, the wire connecting box of a lamp is locked to a retaining block. The center of the block has a hole. A threaded tube is locked to the retaining block. The threaded tube passes through a hole in the retaining block. Then the threaded tube is fixed by screwing with a male nut so that the retaining block will not fall down. A lower side of the retaining block is fixed with a hanging ring so that a lamp can be suspended from the ring. Thereby, the buckling block can load the lamp.

However, above prior art has the following defect. Firstly, the prior art retaining block is made of iron which is cheap, but weak. It is often that after it is used for a time period, the retaining block cracks and thus is dangerous. Moreover, in assembly, the lamp is heavy and much labor is necessary in assembly. Thus the cost is high and the operation is inconvenient.

SUMMARY OF THE INVENTION

Accordingly, the primary object of the present invention is to provide a retaining structure of a lamp for connecting wires which comprises a retaining box, a wire connecting box, a conductive receptacle, a cover and a lamp rod. A periphery of the retaining box has a plurality of through holes. A wire connecting box is made by plastic mold injection with a plurality of buckling seats. Each buckling seat is installed with an inserting hole, a pivotal seat and a via hole. The inserting hole is formed with at least one embedded hole. Each inserting hole is aligned and communicable to the through hole of the retaining box. A conductive receptacle is fixed to the inserting hole. The cover is formed with a plurality of limiting holes for covering the wire connecting box. A front end of the lamp rod is installed with a conductive plug and a rear end of each conductive plug is formed with a buckling groove.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details.

However, these descriptions and the appended drawings are only used to cause those skilled in the art to understand the objects, features, and characteristics of the present invention, but not to be used to confine the scope and spirit of the present invention defined in the appended claims. Furthermore, the present invention can be used to various lamps, including for example, ceiling lamps, wall lamps, table lamps, standing lamps, etc.

Figure 1:
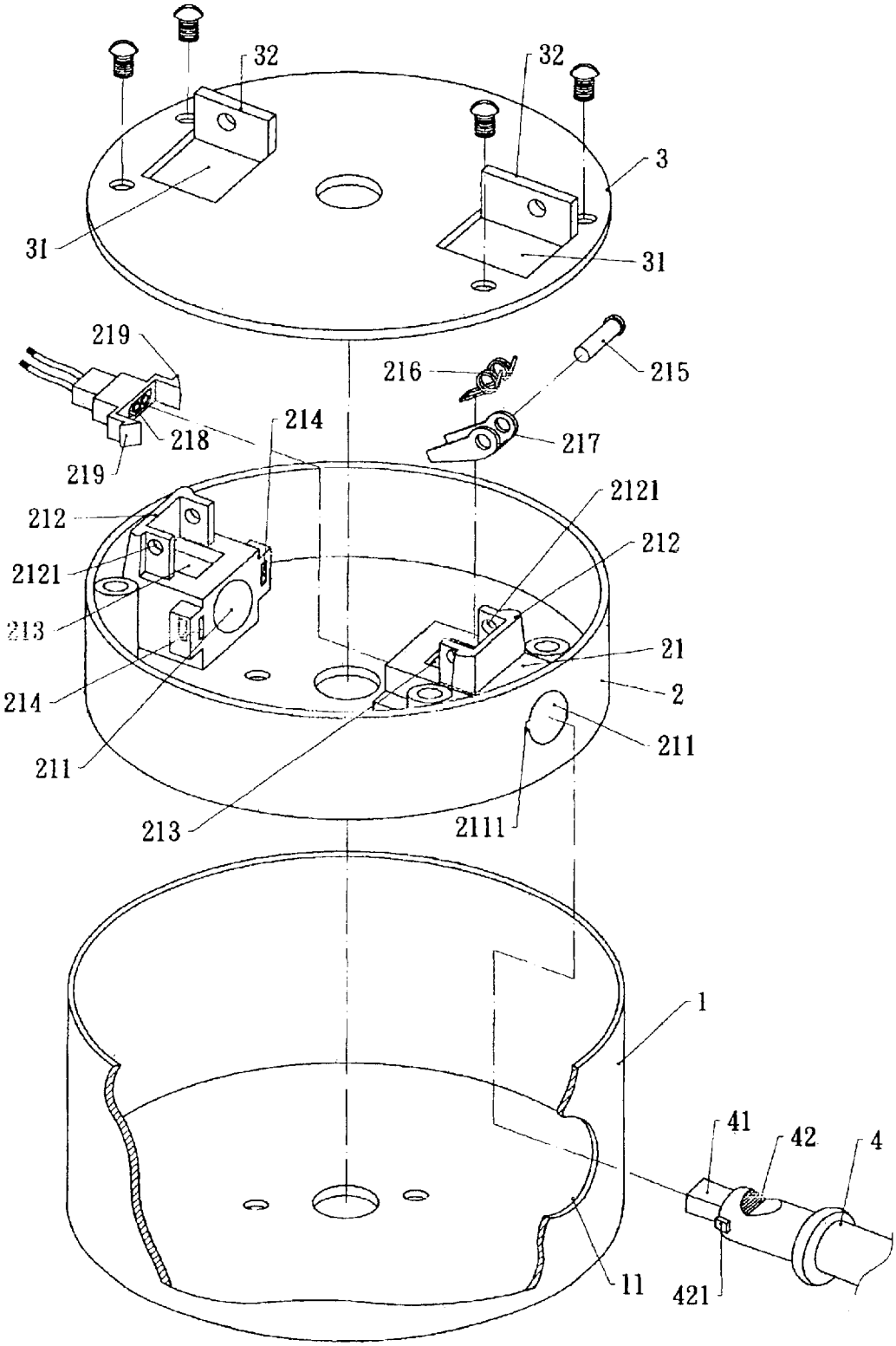
FIG. 1 is an exploded perspective view of the present invention.

Referring to FIG. 1, a periphery of the retaining box 1 has a plurality of through holes 11 which are spaced with an equal space.

A wire connecting box 2 is made by plastic mold injection with a plurality of buckling seats 21. Each buckling seats 21 is installed with an inserting hole 211, a pivotal seat 212 and a via hole 213. Each of the rear two sides of the inserting hole 211 is formed with an embedded hole 214. Each inserting hole 211 is aligned and communicable to the through hole 11 of the retaining box 1. A pivotal seat 212 is installed above the buckling seats 21. A pivotal shaft passes through a twisting spring 216 and a buckle 217 and then is positioned in the pivotal hole 2121 of the pivotal seat 212. The twisting spring 216 resists against the buckle 217 and the buckle 217 is inserted into the via hole 213. Each of two sides of a conductive receptacle 218 is installed with a hook 219. Each hook 219 is embedded into an embedded hole 214 of the buckling seats 21 so as to position the conductive receptacle 218 in the inserting hole 211 without using any locking element or tool.

Figure 2:
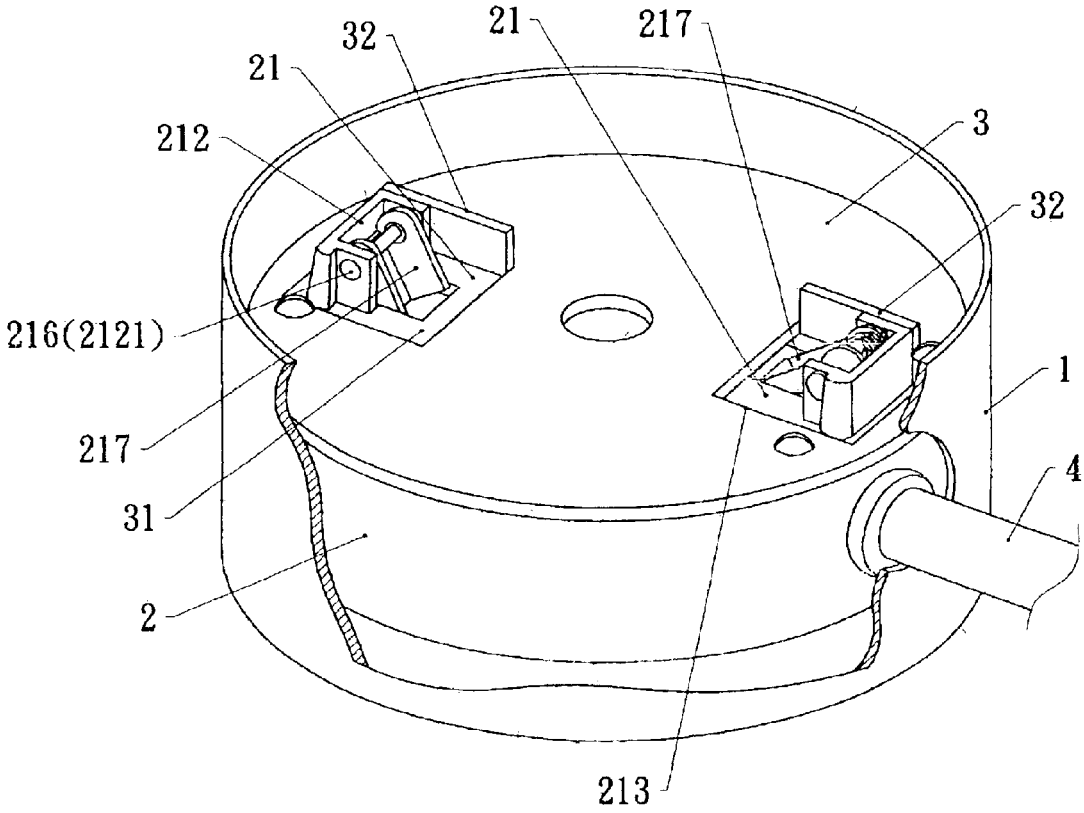
FIG. 2 is an assembly schematic view of the present invention.

Referring to FIGS. 1 and 2, a cover 3 is formed with a plurality of limiting holes 31. At least one side of the limiting hole 31 is installed with a limiting wall 32. The number of the limiting holes 31 is equal to that of the buckling seats 21. When the cover 3 covers on the wire connecting box 2, the buckling seats 21 protrude out of the locating holes 31 and then the pivotal seats 212 of the buckling seats 21 are locked to the limiting walls 32 for enhancing the strength of the pivotal seats 212.

A lamp rod 4 is connected to a plurality of lamp seats and bulbs (not shown). A front end of the lamp rod 4 is installed with a conductive plug 41. A predetermined position at a rear end of the conductive plug 41 is formed with a buckling groove 42. A buckling surface of the buckling groove 42 is installed with skidproof textures 421.

A rear side of the conductive plug 41 is mounted with a limiting block 43 and a recess 2111 is formed in the inserting hole 211 of the buckling seat 21 of the wire connecting box 2. The recess 2111 is correspondent to the limiting block 43 so that when the lamp rod 4 is inserted into the inserting hole 211 of the wire connecting box 2, the limiting block 43 is in the recess 2111 to guide the lamp rod 4 to be correctly connected to the wire connecting box 2

Figure 3A:
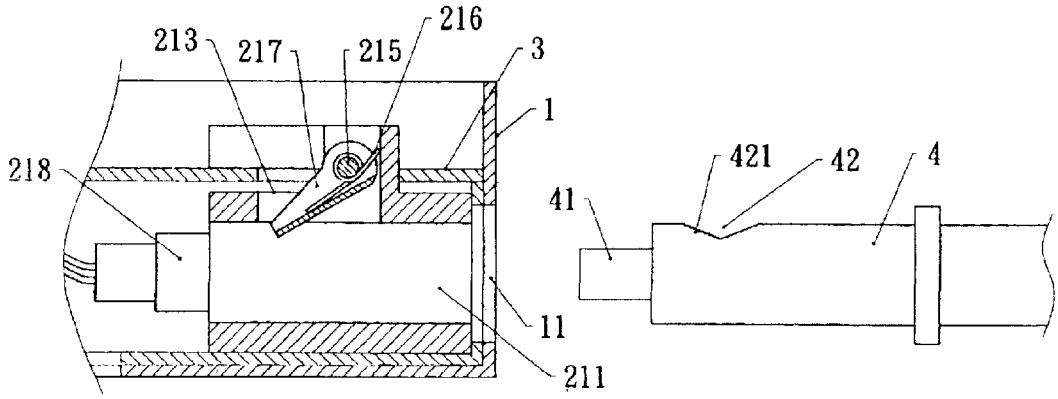
FIGS. 3A, 3B and 3C are exploded perspective view about the assembly of the present invention.
Figure 3B:
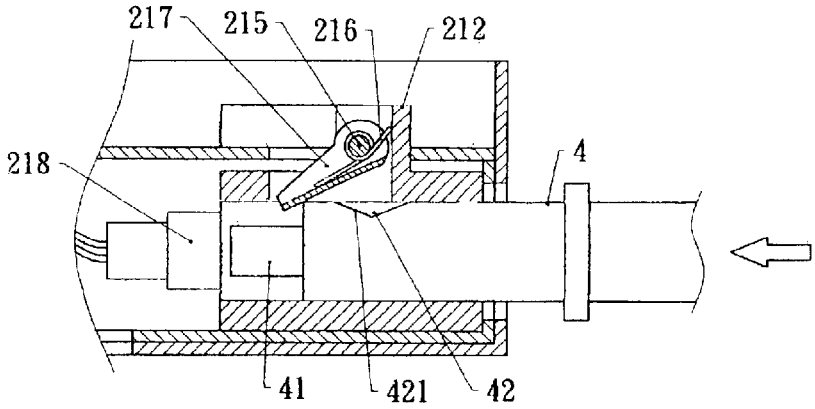
Figure 3C:
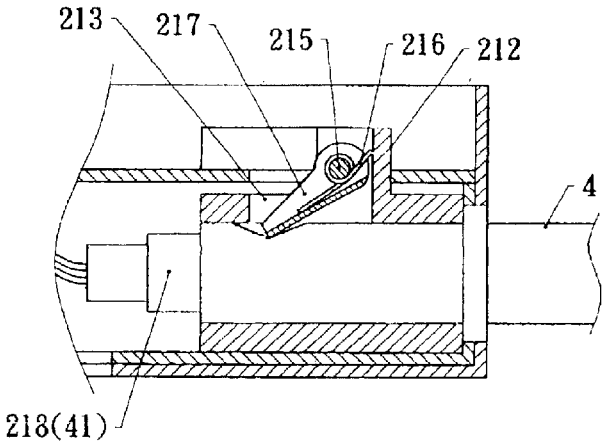

Referring to FIGS. 3A, 3B and 3C, the assembly of the present invention is illustrated. In assembly, the conductive plug 41 of the lamp rod 4 is inserted into the inserting hole 211 of the wire connecting box 2, and then the lamp rod 4 resists the buckle 217 to move upwards and the lamp rod 4 moves forwards in the inserting hole 211. Then the conductive plug 41 is inserted into the conductive receptacle 218 at the rear side of the buckling seat 21 and the buckle 217 is pressed downwards by the twisting spring 216 so as to be buckled in the buckling groove 42 of the lamp rod 4 and thus the lamp rod 4 can not be drawn out and is steadily positioned in the inserting hole 211.

Furthermore, the skidproof textures 421 of the buckling groove 42 provides a stop function of the buckles 217 so as to prevent the lamp rod 4 from being incorrectly positioned and falling of the lamp rod 4 to be the weight itself.

In the present invention, the wire connecting box 2 is integrally formed by plastic injection molding so that the parts necessary are reduced and the present invention can be assembled easily.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A retaining structure of a lamp for connecting wires comprising:

a retaining box; a periphery of the retaining box having a plurality of through holes which are spaced with an equal space;

a wire connecting box made by plastic mold injection with a plurality of buckling seats; each buckling seat being installed with an inserting hole, a pivotal seat and a via hole; a rear side of the inserting hole being formed with at least one embedded hole; each inserting hole being aligned and communicable to the through hole of the retaining box;

a conductive receptacle being fixed to the inserting hole at rear side of each buckling seat;

a cover being formed with a plurality of limiting holes for covering the wire connecting box with the buckling seats protruding from the limiting holes; and a lamp rod; a front end of the lamp rod being installed with a conductive plug; and a predetermined position at a rear end of each conductive plug being formed with a buckling groove.

2. The retaining structure of a lamp for connecting wires as claimed in claim 1, wherein a pivotal seat is installed above the buckling seats; a pivotal shaft passes through a twisting spring and a buckle and then is positioned in the pivotal hole of the pivotal seat; the twisting spring resists against the buckle and the buckle is inserted into the via hole.

3. The retaining structure of a lamp for connecting wires as claimed in claim 1, wherein each conductive receptacle is installed with at least one hook; each hook is embedded into an embedded hole of the buckling seats so as to position the conductive receptacle in the inserting hole.

4. The retaining structure of a lamp for connecting wires as claimed in claim 1, wherein at least one side of the limiting hole is installed with a limiting wall; when the cover covers on the wire connecting box, the buckling seats protrude out of the locating holes and then the pivotal seats of the buckling seats are locked to the limiting walls for enhancing the strength of the pivotal seats.

5. The retaining structure of a lamp for connecting wires as claimed in claim 1, wherein a lateral side of the conductive plug is mounted with a limiting block and a recess is formed in the inserting hole of the buckling seat of the wire connecting box; the recess is positioned with respect to the limiting block so that when the lamp rod is inserted into the inserting hole of the wire connecting box, the limiting block is in the recess so as to guide the lamp rod to be correctly connected to the wire connecting box.

6. The retaining structure of a lamp for connecting wires as claimed in claim 1, wherein a buckling surface of the buckling groove is installed with skidproof textures; the skidproof textures of the buckling groove provides a stop function to the buckles so as to prevent the lamp rod from being incorrectly positioned and falling of the lamp rod to be the weight itself.

* * * * *